US007335630B2

(12) United States Patent
Delplancke et al.

(10) Patent No.: US 7,335,630 B2
(45) **Date of Patent: *Feb. 26, 2008**

(54) LIQUID LAUNDRY DETERGENT COMPOSITIONS WITH SILICONE BLENDS AS FABRIC CARE AGENTS

(75) Inventors: Patrick Firmin August Delplancke, Laarne (BE); Jean-Pol Boutique, Gembloux (BE); Stefano Scialla, Rome (IT); Connie Lynn Sheets, Cincinnati, OH (US); James Charles Theophile Roger Burckett St Laurent, Brussels (BE); Hugo Robert Germain Denutte, Hofstade (Aalst) (BE)

(73) Assignee: The Procter & Gamble Company, Cincinnati, OH (US)

( * ) Notice: Subject to any disclaimer, the term of this patent is extended or adjusted under 35 U.S.C. 154(b) by 23 days.

This patent is subject to a terminal disclaimer.

(21) Appl. No.: 11/107,177

(22) Filed: Apr. 15, 2005

(65) Prior Publication Data

US 2005/0233938 A1 Oct. 20, 2005

Related U.S. Application Data

(60) Provisional application No. 60/562,849, filed on Apr. 16, 2004.

(51) Int. Cl.
*C11D 9/36* (2006.01)

(52) U.S. Cl. ..... 510/466; 510/276; 510/285; 510/287; 510/400; 510/300; 510/304; 510/371; 510/394; 510/407; 510/417

(58) Field of Classification Search ..... 510/276, 510/285, 287, 300, 304, 371, 394, 400, 407, 510/417, 466

See application file for complete search history.

(56) References Cited

U.S. PATENT DOCUMENTS

| | | | | |
|---|---|---|---|---|
| 4,639,321 | A | 1/1987 | Barrat et al. | |
| 5,091,105 | A | 2/1992 | Madore et al. | |
| 5,866,532 | A * | 2/1999 | Jackson et al. | 510/466 |
| 6,117,830 | A * | 9/2000 | Yokosuka et al. | 510/242 |
| 6,432,420 | B2 * | 8/2002 | Ellis et al. | 424/401 |
| 6,506,715 | B1 * | 1/2003 | Schultz et al. | 510/189 |
| 2001/0000467 | A1 | 4/2001 | Murray | |
| 2002/0182161 | A1 * | 12/2002 | Ainger et al. | 424/70.12 |
| 2004/0087464 | A1 * | 5/2004 | Stoessel et al. | 510/407 |
| 2004/0087668 | A1 * | 5/2004 | Schmucker-Castner et al. | 516/90 |
| 2004/0092425 | A1 * | 5/2004 | Boutique et al. | 510/466 |
| 2004/0266653 | A1 * | 12/2004 | Delplancke et al. | 510/470 |

FOREIGN PATENT DOCUMENTS

| | | | |
|---|---|---|---|
| EP | 0 300 525 | | 1/1989 |
| EP | 1 076 129 | A2 | 2/2001 |
| WO | WO 92/01773 | | 2/1992 |
| WO | 99/624662 | * | 12/1999 |
| WO | WO 02/18528 | A1 | 3/2002 |
| WO | WO 2005/007790 | A1 | 1/2005 |

OTHER PUBLICATIONS

International Search Report mailed Jul. 8, 2005, 5 pages.

* cited by examiner

*Primary Examiner*—Charles Boyer
(74) *Attorney, Agent, or Firm*—Armina E. Matthews; Kim William Zerby

(57) ABSTRACT

The invention is directed to aqueous liquid laundry detergent compositions for cleaning and imparting fabric care benefits to fabrics laundered therewith. Such compositions comprise (A) at least one detersive surfactant; (B) droplets of a silicone blend comprising a nitrogen-containing amino or ammonium functionalized polysiloxane and a nitrogen-free non-functionalized polysiloxane; and (C) at least one additional non-silicone laundry adjunct selected from detersive enzymes, dye transfer inhibiting agents, optical brighteners, suds suppressors and combinations thereof. The functionalized polysiloxane component of the silicone blend has a relatively low, i.e., less than 30 mol %, content of reactive/curable groups, a nitrogen content which ranges from 0.05% to 0.30% by weight and a viscosity which ranges from 0.00002 $m^2/s$ to 0.2 $m^2/s$. The nitrogen-free non-functionalized polysiloxane material ranges in viscosity from 0.01 $m^2/sec$ to 2.0 $m^2/sec$. The silicone blend is preferably used in a pre-formed emulsion which can be added to the balance of the detergent composition to form the droplets of the silicone blend which are dispersed in the detergent composition.

19 Claims, No Drawings

LIQUID LAUNDRY DETERGENT COMPOSITIONS WITH SILICONE BLENDS AS FABRIC CARE AGENTS

This application claims the benefit of U.S. Provisional Application No. 60/562,849, filed on Apr. 16, 2004.

FIELD OF THE INVENTION

This invention relates to liquid laundry detergent compositions containing functionalized silicone materials as fabric care agents.

BACKGROUND OF THE INVENTION

When consumers launder fabrics, they desire not only excellence in cleaning, they also seek to impart superior fabric care benefits via the laundering process. Such fabric care benefits to be imparted can be exemplified by one or more of reduction, prevention or removal of wrinkles; the improvement of fabric softness, fabric feel or garment shape retention or recovery; improved elasticity; ease of ironing benefits; color care; anti-abrasion; anti-pilling; or any combination of such benefits. Detergent compositions which provide both fabric cleaning performance and additional fabric care effects, e.g., fabric softening benefits, are known as "2-in-1"-detergent compositions and/or as "softening-through-the-wash"-compositions.

Due to the incompatibility of anionic detersive surfactants and many cationic fabric care agents, e.g., quaternary ammonium fabric softening agents, in liquid detergent compositions, the detergent industry has formulated alternative compositions which utilize fabric care agents which are not necessarily cationic in nature. One such type of alternative fabric care agents comprises silicone, i.e., polysiloxane-based, materials. Silicone materials include nonfunctional types such as polydimethylsiloxane (PDMS) and functionalized silicones, and can be deposited onto fabrics during the wash cycle of the laundering process. Such deposited silicone materials can provide a variety of benefits to the fabrics onto which they deposit. Such benefits include those listed hereinbefore.

Non-functionalized silicones, however good in their compatibility with detergents, have shortcomings. Such non-functionalized silicones can produce excellent fabric care benefits when directly applied to textiles, yet are found to work ineffectively in liquid laundry detergents. The problem is a complex one and includes inadequate deposition in the presence of surfactants, unsatisfactory spreading, inadequate emulsion stability and other factors. When such non-functional materials do not deposit effectively, a major proportion of the silicone is lost to the drain at the end of the wash, rather than being deposited evenly and uniformly on the fabrics, e.g., clothing, being washed.

One specific type of silicones which can provide especially desirable deposition and fabric substantivity improvements comprises the functionalized, nitrogen-containing silicones. These are materials wherein the organic substituents of the silicon atoms in the polysiloxane chain contain one or more amino and/or quaternary ammonium moieties. The terms "amino" and "ammonium" in this context most generally means that there is at least one substituted or unsubstituted amino or ammonium moiety covalently bonded to, or covalently bonded in, a polysiloxane chain and the covalent bond is other than an Si—N bond, e.g., as in the moieties —[Si]—O—$CR'_2$—$NR_3$, —[Si]—O—$CR'_2$—$NR_3$ —[Si]—$OCR'_2$—$N^+R_4$, —[Si]—$OCR'_2$—$N^+HR_2$ —[Si]—O—$CR'_2$—$N^+HR_2$ —[Si]—$CR'_2$—$NR_3$ etc. where —[Si]— represents one silicon atom of a polysiloxane chain. Amino and ammonium functionalized silicones as fabric care and fabric treatment agents are described, for example, in EP-A-150,872; EP-A-577,039; EP-A-1,023,429; EP-A-1,076,129; and WO 02/018528.

Functionalized, nitrogen-containing silicones such as these can be used in and of themselves to impart a certain amount and degree of fabric care benefit. However such functionalized silicones also have shortcomings. For example it is known that they can react chemically with components of detergents. Mechanisms of reaction have not been well documented but can in principle include reactions of aminofunctional groups themselves, as well as reactions of curable groups present within such functionalized polymers. The art is ambivalent on the possibility of successfully including reactive or curable silicones in detergents without stability problems. On one hand there are references teaching desirablity of having curable or reactive moieties, and on the other hand there are references teaching desirability of avoiding all reactive moieties (in this context including ammonium or aminofunctional moieties) in various cleaning compositions.

Functionalized, nitrogen-containing silicone materials useful as fabric care agents can be prepared from nitrogen-substituted alkoxysilanes or alkoxysiloxanes as starting materials. (See for example, the processes disclosed in EP-A-269,886 and U.S. Pat. No. 6,093,841.) Such preparation can involve hydrolysis of the starting materials followed by catalytic equilibration and condensation with non-functionalized siloxanes. Depending on the process involved and conditions used, the resulting amino or ammonium functionalized silicones will contain reactive groups on the silicon atoms, and especially the terminal silicon atoms, of the siloxane chains in such reaction product material. Such reactive groups can comprise —H, —OH, and —OR moieties originally present in the silane and siloxane starting materials. In view of the state of the art it is not currently possible to predict what overall structures, and what levels of reactive groups in particular, can be accommodated in a stable and effective fabric-care-benefit-providing liquid laundry detergent composition. Yet, it would be highly desirable to solve this problem in order that synthesis routes such as the above, found desirable for manufacturing reasons, can be applied to the provision of improved fabric care detergents.

Processes which remove reactive groups from the functionalized silicone end product serve to render those end products "nonreactive." However, it is desirable to conduct such additional processes only to the minimum extent required for good liquid detergent fabric care benefit performance and stability, or the processes are wasteful and costly. The problem of determining the correct composition of miscible blends of silicones in terms of structure and in terms of parameters such as nitrogen content and reactive group content so as to select preferred fabric care liquid laundry detergents has now been solved.

It has now been determined what concentrations of residual reactive groups can cause problems when the resulting functionalized silicone materials are used as, or as part of, fabric care agents in liquid detergent compositions. The use of silicones containing these reactive group concentrations leads to deactivation of the functionalized silicones themselves and/or to deactivation of other components of the liquid detergent compositions. Use in liquid detergents of functionalized silicones with significant levels of reactive groups can also lead to formation of higher molecular weight, higher viscosity, or unspreadable polymeric materials upon storage of the liquid detergent products and this in turn leads to severe reduction or even loss of fabric care benefits either immediately or on storage and with passage of time.

It has now been discovered that such problems can be negated or minimized by using in liquid laundry detergent products droplets of a silicone blend of preferably miscible silicones comprising certain amino and ammonium functionalized silicone material in combination with certain kinds of non-functionalized polysiloxanes. The amino and ammonium functionalized silicones used are those which have been prepared in a manner to minimize the presence therein of certain types of reactive moieties. These selected amino and ammonium functionalized silicones are also those which have a specific balance of amine and/or ammonium functionality, as quantified by nitrogen content, and silicone viscosity and preferably molecular weight. Without being limited by theory, the nitrogen content is fundamentally linked to the ability to obtain miscibility of the functionalized and non-functionalized silicones, and the blend combination of the two acts synergistically. Moreover, while the levels of reactive group content needed are low, they do not need to be zero. This is believed to be due, at least in part, to the ability of the non-functionalized silicone to protect the functionalized silicone from interaction with other components of the detergent composition.

The present invention therefore offers numerous advantages. First, an improved aqueous liquid laundry detergent having excellent fabric care benefits, especially softness and handle, is obtained. Second, use of wasteful levels of silicones is avoided. Third, the more expensive and complex functionalized silicones can be used at reasonable levels. Fourth, the compositions are stable and effective for their intended industrial purposes. Other advantages include that the compositions are non-yellowing on white textiles and moreover, that they do not give uneven deposition or lead to unacceptable visual results on clothing.

SUMMARY OF THE INVENTION

The present invention is directed to aqueous (e.g., containing upwards of from 4% by weight water) liquid laundry detergent compositions which are suitable for cleaning and imparting fabric care benefits to fabrics laundered using such a composition. Such compositions comprise:

(A) at least one detersive surfactant selected from anionic surfactants, nonionic surfactants, zwitterionic surfactants, amphoteric surfactants, and combinations thereof;

(B) droplets of a blend of silicone materials wherein the blend comprises both amino- and/or ammonium-functionalized polysiloxanes and nitrogen-free, non-functionalized polysiloxanes; and, (C) at least one additional non-silicone laundry adjunct selected from detersive enzymes; dye transfer inhibiting agents, optical brighteners, suds suppressors, and combinations thereof.

The specific amino and/or ammonium functionalized polysiloxane materials used are those which have been prepared by a process which intrinsically leaves reactive/curable groups in the functionalized polysiloxane material which is produced. Preferably such a process comprises hydrolysis of nitrogen-containing alkoxysilane and/or alkoxysiloxane starting materials and catalytic equilibration and condensation of these hydrolyzed starting materials. Notwithstanding the tendency of the process used to leave reactive/curable groups within the resulting functionalized polysiloxane materials, such materials must be further processed in a manner which reduces and minimizes the amount of such reactive/curable groups which remain. In fact, the amino and/or ammonium functionalized polysiloxane materials used must have a molar ratio of curable/reactive group-containing silicon atoms to terminal silicon atoms containing no reactive/curable groups which is less than 30%. Syntheses of the functionalized silicones are adapted herein to secure appropriate curable/reactive group contents, which can theoretically be zero or, more economically, can be non-zero while remaining at low and compatible levels. Such amino and/or ammonium functionalized polysiloxane materials also have a nitrogen content ranging from 0.05% to 0.30% by weight and a viscosity at 20° C. ranging from 0.00002 $m^2/s$ to 0.2 $m^2/s$.

The nitrogen-free, non-functionalized polysiloxane material which forms part of the silicone blend has a viscosity which ranges from 0.01 $m^2/s$ to 2.0 $m^2/s$. It is present in an amount such that the weight ratio of functionalized to non-functionalized siloxanes within the silicone blend ranges from 100:1 to 1:100. The functionalized silicone and nitrogen-free, non-functionalized polysiloxane materials are preferably fully miscible at the specified nitrogen content of the functionalized silicone. This leads to droplets of the resulting blend which are more effective for providing fabric care benefits, e.g., softness or feel of textiles on the skin, than either of the materials alone.

DETAILED DESCRIPTION OF THE INVENTION

The essential and optional components of the liquid laundry detergent compositions herein, as well as composition form, preparation and use, are described in greater detail as follows: In this description, all concentrations and ratios are on a weight basis of the liquid laundry detergent unless otherwise specified. Percentages of certain compositions herein, such as silicone emulsions prepared independently of the liquid laundry detergent, are likewise percentages by weight of the total of the ingredients that are combined to form these compositions. Elemental compositions such as percentage nitrogen (% N) are percentages by weight of the silicone referred to.

Molecular weights of polymers are number average molecular weights unless otherwise specifically indicated. Particle size ranges are ranges of median particle size. For example a particle size range of from 0.1 micron to 200 micron refers to the median particle size having a lower bound of 0.1 micron and an upper bound of 200 microns. Particle size may be measured by means of a laser scattering technique, using a Coulter LS 230 Laser Diffraction Particle Size Analyser from Coulter Corporation, Miami, Fla., 33196, USA.

Viscosity is measured with a Carrimed CSL2 Rheometer at a shear rate of 21 $sec^{-1}$. Viscosity expressed in $m^2/sec$ can be multiplied by 1,000,000 to obtain equivalent values in Centistokes (Cst). Viscosity expressed in Cst can be divided by 1,000,000 to obtain equivalent values in $m^2/sec$. Additionally, Kinematic viscosity can be converted to Absolute viscosity using the following conversion: multiply kinematic viscosity given in centistokes by density ($grams/cm^3$) to get absolute viscosity in centipoise (cp or cps).

All documents cited herein are, in relevant part, incorporated herein by reference. The citation of any document is not to be considered as an admission that it is prior art with respect to the present invention.

A) Surfactants—The present compositions comprise as one essential component at least one surfactant selected from the group consisting anionic surfactants, nonionic surfactants, zwitterionic surfactants, amphoteric surfactants, and combinations thereof. The surfactant component can be employed in any concentration which is conventionally used to effectuate cleaning of fabrics during conventional laundering processes such as those carried out in automatic washing machines in the home. Suitable surfactant component concentrations include those within the range from 5% to 80%, preferably from 7% to 65%, and more preferably from 10% to 45%, by weight of the composition.

Any detersive surfactant known for use in conventional laundry detergent compositions may be utilized in the compositions of this invention. Such surfactants, for example include those disclosed in "Surfactant Science Series", Vol. 7, edited by W. M. Linfield, Marcel Dekker. Non-limiting examples of anionic, nonionic, zwitterionic, amphoteric or mixed surfactants suitable for use in the compositions herein are described in McCutcheon's, Emulsifiers and Detergents, 1989 Annual, published by M. C. Publishing Co., and in U.S. Pat. Nos. 5,104,646; 5,106,609; 3,929,678; 2,658,072; 2,438,091; and 2,528,378.

Preferred anionic surfactants useful herein include the alkyl benzene sulfonic acids and their salts as well as alkoxylated or un-alkoxylated alkyl sulfate materials. Such materials will generally contain form 10 to 18 carbon atoms in the alkyl group. Preferred nonionic surfactants for use herein include the alcohol alkoxylate nonionic surfactants. Alcohol alkoxylates are materials which correspond to the general formula:

$$R^1(C_mH_{2m}O)_nOH$$

wherein $R^1$ is a $C_8$-$C_{16}$ alkyl group, m is from 2 to 4, and n ranges from about 2 to 12. Preferably $R^1$ is an alkyl group, which may be primary or secondary, that contains from about 9 to 15 carbon atoms, more preferably from about 10 to 14 carbon atoms. Preferably also the alkoxylated fatty alcohols will be ethoxylated materials that contain from about 2 to 12 ethylene oxide moieties per molecule, more preferably from about 3 to 10 ethylene oxide moieties per molecule.

B) Silicone Component—The present compositions essentially contain droplets of a blend of certain types of silicone materials. This blend of silicone materials comprises both amino and/or ammonium group-containing functionalized polysiloxane materials and nitrogen-free, non-functionalized polysiloxane materials. (For purposes of describing this invention, the terms "polysiloxane" and "silicone" can be and are herein used interchangeably.)

Both the functionalized and non-functionalized polysiloxanes used in the silicone blend are built up from siloxy units which are chosen from the following groups:

(Q)

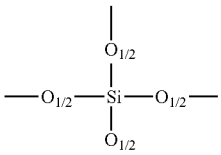

-continued (T)

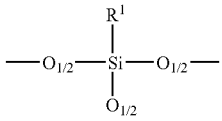

(D)

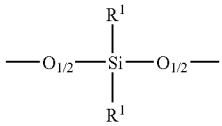

(M)

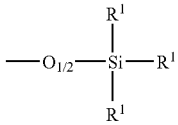

wherein the $R^1$ substituents represent organic radicals, which can be identical or different from one another. In the amino or ammonium group-containing functionalized polysiloxanes used herein, at least one of the $R^1$ groups essentially comprises nitrogen in the form of an amino or quaternary moiety, and optionally and additionally may comprise nitrogen in the form of an amide moiety so as to form an amino-amide. In the non-functionalized polysiloxanes used herein, none of the $R^1$ groups are substituted with nitrogen in the form of an amino or quaternary ammonium moiety.

The $R^1$ groups for each type of polysiloxanes correspond to those defined more particularly in one or more of the additional general formulas set forth hereinafter for these respective types of polysiloxane materials. However, these Q, T, D and M designations for these several siloxy unit types will be used in describing the preparation of the functionalized polysiloxanes in a manner which minimizes the content of reactive groups in these functionalized materials. These Q, T, D and M designations are also used in describing the NMR monitoring of the preparation of these materials and the use of NMR techniques to determine and confirm reactive group concentrations.

(b1) Functionalized Polysiloxanes:

For purpose of the present invention, the functionalized silicone is a polymeric mixture of molecules each having a straight, comb-like or branched structure containing repeating SiO groups. The molecules comprise functional substituents which comprise at least one nitrogen atom which is not directly bonded to a silicon atom. The functionalized silicones selected for use in the compositions of the present inventions include amino-functionalized silicones, i.e., there are silicone molecules present that contain at least one primary amine, secondary amine, or tertiary amine. Quaternized amino-functionalized silicones, i.e. quaternary ammonium silicones, are also encompassed by the definition of functionalized silicones for the purpose of the present invention. The amino groups can be modified, hindered or blocked in any known manner which prevents or reduces the known phenomenon of aminosilicone fabric care agents to cause yellowing of fabrics treated therewith if, for example, materials too high in nitrogen content are employed.

The functionalized silicone component of the silicone blend will generally be straight-chain, or branched polysiloxane compounds which contain amino or ammonium groups in the side groups (i.e., the amino or ammonium groups are present in groups having general structures designated D or T) or at the chain ends (i.e., the amino or ammonium groups are present in groups having general structures designated M). Furthermore, in such functionalized silicones the molar ratio of curable/reactive group-containing silicon atoms to non-curable/reactive group-containing terminal silicon atoms, e.g., the molar ratio of hydroxyl- and alkoxy-containing silicon atoms to non-hydroxyl- or alkoxy-containing terminal silicon atoms, is from 0% to no more than 30%, i.e., 0.3 mole fraction. This includes, in preferred embodiments, low but non-zero levels that are preferably less than 20%, more preferably less than 10%, more preferably less than 5%, more preferably still, less than 1% Suitably this low level of reactive groups, as determined on the neat (undiluted, not yet formulated) functionalized silicone dissolved at a concentration of, for example, 20% by weight in a solvent such as deuterated chloroform is from about the practical analytical detection threshold (nuclear magnetic resonance) to no more than 30%.

"Hydroxyl- and alkoxy-containing silicon atoms" in this context means all M, D, T and Q groups which contain an Si—OH or Si—OR grouping. (It should be noted that D groups which contain —OH or —OR substituents on the silicon atom will generally comprise the terminal Si atoms of the polysiloxane chain.) The "non-hydroxyl- or alkoxy-containing terminal silicon atoms" means all M groups which contain neither a Si—OH nor a Si—OR group. This molar ratio of hydroxyl- and alkoxy-containing silicon atoms to non-hydroxyl- or alkoxy-containing terminal silicon atoms is expediently determined according to the present invention by nuclear magnetic resonance (NMR) spectroscopy methods, preferably by $^{1}$H-NMR and $^{29}$Si-NMR, particularly preferably by $^{29}$Si-NMR. According to this invention, this molar ratio of hydroxyl- and alkoxy-containing silicon atoms to non-hydroxyl- or alkoxy-containing terminal silicon atoms is expediently the ratio of the integrals of the corresponding signals in $^{29}$Si-NMR.

The molar ratio used herein can be determined, for example in the case of the functionalized silicone having Formula B hereinafter and where $R^1$=methyl, aminopropyl and methoxy, from the ratio of the signal integrals (I) at shifts represented by:

−11 ppm (D-OH=$(CH_3)_2(HO)SiO$—),

−13 ppm (D-OMe=$(CH_3)_2(CH_3O)SiO$—) and 7 ppm (M=$(CH_3)_3SiO$—).

Thus the Ratio=$(I_{-11\ ppm}+I_{-13\ ppm})/I_{7\ ppm}\times 100\%$. (For purposes of this invention, this molar ratio is expressed as a percentage which is referred to as the percent content of curable/reactive groups in the functionalized silicone.)

For other alkoxy groupings, such as, for example, ethoxy, signals in the $^{29}$Si-NMR can be assigned accordingly. The NMR practitioner is readily able to assign the corresponding chemical shifts for differently substituted siloxy units. It is also possible to use the $^{1}$H-NMR method in addition to the $^{29}$Si-NMR method. A suitable set of NMR conditions, procedures and parameters is set forth in the Examples hereinafter. Infra-red spectroscopy can also be used.

According to the invention, it is furthermore preferable that not only is the molar ratio of hydroxyl- and alkoxy-containing silicon atoms to non-hydroxyl- or alkoxy-containing terminal silicon atoms less than 20%, but also the molar ratio of all the silicon atoms carrying reactive groups to the non-reactive M groups is less than 20%. The limit value of 0% in the context of the invention means that preferably silicon atoms containing reactive groups can no longer be detected by suitable analytical methods, such as NMR spectroscopy or infra-red spectroscopy. It should be noted that, in view of the preparative methods for the functionalized silicone materials, having no reactive groups or having them at very limited levels does not follow automatically from mere presentation of chemical structures not having such reactive groups. Rather, reactive group content must be practically secured at the specified levels by adapting the synthesis procedure for these materials, as is provided for herein.

In the context of this invention, non-reactive chain-terminating M groups represent structures which, in the environment of the detergent formulations herein, are not capable of forming covalent bonds with a resulting increase in the molecular weight of materials formed. In such non-reactive structures, the substituents $R^1$ include, for example, Si—C-linked alkyl, alkenyl, alkynyl and aryl radicals, which optionally can be substituted by N, O, S and halogen. The substituents are preferably $C_1$ to $C_{12}$ alkyl radicals, such as methyl, ethyl, vinyl, propyl, isopropyl, butyl, hexyl, cyclohexyl and ethylcyclohexyl.

In the context of the invention, M, D, T and Q structures with curable/reactive groups mean and represent, in particular, structures which do not contain the amino or quaternary nitrogen moieties and which, in the environment of the detergent formulations herein, are capable of forming covalent bonds, thereby creating material of increased molecular weight. In such structures, the predominant curable/reactive units are the Si—OH and SiOR units as mentioned, and can furthermore also include epoxy and/or ≡SiH and/or acyloxysilyl groups, and/or Si—N—C-linked silylamines and/or Si—N—Si-linked silazanes. Examples of alkoxy-containing silicon units are the radicals $\equiv SiOCH_3$, $\equiv SiOCH_2CH_3$, $\equiv SiOCH(CH_3)_2$, $\equiv SiOCH_2CH_2CH_2CH_3$ and $\equiv SiOC_6H_5$. An example of an acyloxysilyl radical is $\equiv SiOC(O)CH_3$. For silylamine groups, $\equiv SiN(H)CH_2CH{=}CH_2$ may be mentioned by way of example, and for silazane units $\equiv SiN(H)Si(CH_3)_3$.

The primary reaction of the abovementioned curable/reactive groups present, for example in detergent formulations, which reaction leads to the undesirable increase in molecular weight of the functionalized silicone, is condensation and elimination with subsequent formation of new SiOSi bonds not originally present in the functionalized silicone. Alternatively, it is conceivable that in detergent formulations, for example, strong interactions occur with non-volatile polyhydroxy compounds, polycarboxy compounds or salts thereof, sulfonic acids or salts thereof, monoalkyl sulphates, monoalkyl ether-sulphates, carboxylic acids or salts thereof and carbonates, leading to an uncontrolled reaction or coordination of the aminosiloxane with reaction of the reactive groups mentioned, such as, in particular, the Si—OH and SiOR groups, with formation of material of increased molecular weight. It is not the precise nature of the chemical reaction or interaction which is essential in the context of the invention. Rather, it is the fact that these transformations occur which leads to a decrease in the fabric benefit effects provided by the amino- and/or ammoniumpolysiloxane if the molar ratio of reactive/curable group-containing silicon atoms to non-reactive/curable group-containing silicon atoms i.e., the molar ratio of hydroxyl- and alkoxy-containing silicon atoms to non-hydroxyl- or alkoxy-containing terminal silicon atoms, is more than the specified limited levels, for example in a detergent matrix over a relatively long period of time.

The functionalized silicones used herein and having the requisite levels of reactive groups can be prepared by a process which involves:

i) hydrolysis of alkoxysilanes or alkoxysiloxanes;

ii) catalytic equilibration and condensation; and iii) removal of the condensation products from the reaction system, for example with an entraining agent such as an inert gas flow.

Using this combined hydrolysis/equilibration process, the functionalized silicones herein can be prepared for example, on the one hand from organofunctional alkoxysilanes or alkoxysiloxanes, and on the other hand with non-functional alkoxysilanes or alkoxysiloxanes. Instead of the organofunctional alkoxysilanes or the non-functional alkoxysilanes, other silanes containing hydrolysable groups on the silicon, such as, for example, alkylaminosilanes, alkylsilazanes, alkylcarboxysilanes, chlorosilanes etc. can be subjected to the combined hydrolysis/equilibration process.

In accordance with this preparation procedure, amino-functional alkoxysilanes, water, corresponding siloxanes containing M, D, T and Q units and basic equilibration catalysts initially can be mixed with one another in appropriate ratios and amounts. Heating to 60° C. to 230° C. can then be carried out, with constant thorough mixing. The alcohols split off from the alkoxysilanes and subsequently water can be removed stepwise. The removal of these volatile components and the substantial condensation of undesirable reactive groups can be promoted by using a reaction procedure at elevated temperatures and/or by applying a vacuum.

In order to achieve enhanced removal of the reactive groups, in particular the hydroxyl and alkoxy groups on the silicon atoms, which is as substantial as needed, it has been found that this is rendered possible by a further process step which comprises the removal of the vaporizable condensation products, such as, in particular, water and alcohols, from the reaction mixture by means of an entraining agent. Entraining agents which can be employed to prepare functionalized polysiloxanes to be used according to this invention are: carrier gases, such as nitrogen, low-boiling solvents or oligomeric silanes or siloxanes. The removal of the vaporizable condensation products is preferably carried out by azeotropic distillation out of the equilibrium. Suitable entraining agents for these azeotropic distillations include, for example, entraining agents with a boiling range from about 40 to 200° C. under (normal pressure (1 bar)). Higher alcohols, such as butanol, pentanol and hexanol, halogenated hydrocarbons, such as, for example, methylene chloride and chloroform, aromatics, such as benzene, toluene and xylene, or siloxanes, such as hexamethyldisiloxane and octamethylcyclotetrasiloxane, are preferred. The preparation of the desired aminosiloxanes can be monitored by suitable methods, such as NMR spectroscopy or FTIR spectroscopy, and is concluded when a content of reactive groups which lies within the scope according to the invention is determined.

In one embodiment of this hydrolysis/equilibration process, the desired aminoalkylalkoxysilanes can be prepared in a prior reaction from halogenoalkyl-, epoxyalkyl- and isocyanatoalkyl-functionalized alkoxysilanes. This procedure can be employed successfully if the aminoalkylalkoxysilanes required are not commercially available. Examples of suitable halogenoalkylalkoxysilanes are chloromethylmethyldimethoxysilane and chloropropylmethyldimethoxysilane, an example of epoxyalkylalkoxysilanes is glycidylpropylmethyldmethoxysilane and examples of isocyanate-functionalized silanes are isocyanatopropylmethyldiethoxysilane and isocyanatopropyltriethoxysilane. It is also possible to carry out the functionalization to amino-functional compounds at the stage of the silanes or the equilibrated siloxanes.

Ammonia or structures containing primary, secondary and tertiary amino groups can be used in the preparation of the amino-functionalized silanes and siloxanes. Diprimary amines are of particular interest, and here in particular diprimary alkylamines, such as 1,6-diaminohexane and 1,12-diaminododecane, and diprimary amines based on polyethylene oxide-polypropylene oxide copolymers, such as Jeffamine® of the D and ED series (Huntsman Corp.) can be used. Primary-secondary diamines, such as aminoethylethanolamine, are furthermore preferred. Primary-tertiary diamines, such as N,N-dimethylpropylenediamine, are also preferred. Secondary-tertiary diamines, such as N-methylpiperazine and bis-(N,N-dimethylpropyl)amine, represent a further group of preferred amines. Tertiaryamines, such as trimethylamine, N-methylmorpholine and N,N-dimethylethanolamine, are also preferred. Aromatic amines, such as imidazole, N-methylimidazole, aminopropylimidazole, aniline and N-methylaniline, can also advantageously be employed. After the synthesis has been carried out, these aminoalkylalkoxysilanes are used in the combined hydrolysis/equilibration process hereinbefore described.

Alternatively to the combined hydrolysis/equilibration process, a two-stage process procedure can also be followed. A siloxane precursor high in amino groups is prepared in a separate first step. It is essential that this siloxane precursor is substantially free from reactive groups, for example silanol and alkoxysilane groups. The synthesis of this siloxane precursor high in amino groups is carried out using the hydrolysis/condensation/equilibration concept already described. A relatively large amount of the amino-functional alkoxysilane, water and relatively small amounts of siloxanes containing M, D, T and Q units as well as basic equilibration catalysts are first mixed with one another in appropriate ratios and amounts. Heating to 60° C. to 230° C. is then carried out with constant thorough mixing, and the alcohols split off from the alkoxysilanes and subsequently water are removed stepwise as hereinbefore described. The composition of this siloxane precursor high in amino groups, including the content of reactive groups, can be determined by suitable methods, such as titration, NMR spectroscopy or FTIR spectroscopy.

In a second, separate equilibration step, the actual target product can be prepared from this siloxane precursor high in amino groups and siloxanes containing M, D, T and Q units under base or acid catalysis. According to requirements for minimization of the end contents of reactive groups, this can again be carried out, as already described, at elevated temperature and/or with vacuum and with azeotropic distillation. The essential advantage of this two-stage method is that the final equilibration proceeds with substantial exclusion of e.g. water and alcohols and the contents of reactive groups in the starting substances are small and known. It is possible to carry out the aminoalkylalkoxysilane synthesis described above in series with the two-stage synthesis.

In addition to having the requisite relatively low content of reactive/curable groups, the functionalized silicones used herein must also have a % anine/ammonium functionality, i.e., nitrogen content or % N by weight, in the range of from 0.05% to 0.30%. More preferably, nitrogen content ranges from 0.10% to 0.25% by weight. Nitrogen content can be determined by conventional analytical techniques such as by direct elemental analysis or by NMR.

In addition to having the specified curable/reactive group and nitrogen content characteristics, the functionalized silicone materials used herein must also have certain viscosity characteristics. In particular, the functionalized polysiloxane materials used herein will have a viscosity from 0.00002 $m^2/s$ (20 centistokes at 20° C.) to 0.2 $m^2/s$ (200,000 centistokes at 20° C.), preferably from 0.001 $m^2/s$ (1000 centistokes at 20° C.) to 0.1 $m^2/s$ (100,000 centistokes at 20° C.), and more preferably from 0.002 $m^2/s$ (2000 centistokes at 20° C.) to 0.01 $m^2/s$ (10,000 centistokes at 20° C.).

The preferred functionalized silicones will also have a molecular weight in the range of from 2,000 Da to 100,000 Da, preferably from 15,000 Da to 50,000 Da, most preferably from 20,000 Da to 40,000 Da, most preferably from 25,000 Da to 35,000 Da.

Examples of preferred functionalized silicones for use in the compositions of the present invention include but are not limited to, those which conform to the general formula (A):

$$(R^1)_aG_{3-a}\text{-Si}—(—OSiG_2)_n\text{-}(—OSiG_b(R^1)_{2-b})_m—O—SiG_{3-a}(R^1)_a \quad (A)$$

wherein G is phenyl, or $C_1$-$C_8$ alkyl, preferably methyl; a is 0 or an integer having a value from 1 to 3, preferably 0; b is 0, 1 or 2, preferably 1; n is a number from 49 to 1299, preferably from 100 to 1000, more preferably from 150 to 600; m is an integer from 1 to 50, preferably from 1 to 5; most preferably from 1 to 3 the sum of n and m is a number from 50 to 1300, preferably from 150 to 600; $R^1$ is a monovalent radical conforming to the general formula $C_qH_{2q}L$, wherein q is an integer having a value from 2 to 8 and L is selected from the following groups: $—N(R^2)CH_2—CH_2—N(R^2)_2$; $—N(R^2)_2$; wherein $R^2$ is hydrogen, phenyl, benzyl, hydroxyalkyl or a saturated hydrocarbon radical, preferably an alkyl radical of from $C_1$ to $C_{20}$.

A preferred aminosilicone corresponding to formula (A) is the shown below in formula (B):

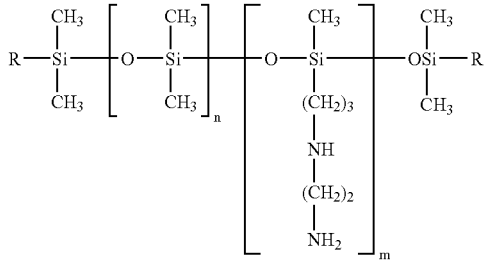

wherein R is independently selected from $C_1$ to $C_4$ alkyl, hydroxyalkyl and combinations thereof, preferably from methyl and wherein n and m are hereinbefore defined. When both R groups are methyl, the above polymer is known as "trimethylsilylamodimethicone".

b1) Non-Functionalized Silicones

For purposes of this invention, a non-functionalized silicone is a polymer containing repeating SiO groups and substitutents which comprise of carbon, hydrogen and oxygen. Thus, the non-functionalized silicones selected for use in the compositions of the present invention include any nonionic, non-cross linked, nitrogen-free, non-cyclic silicone polymer.

Preferably, the non-functionalized silicone is selected from nonionic nitrogen-free silicone polymers having the Formula (I):

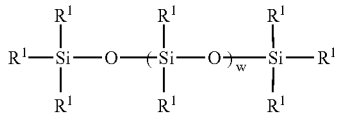

(I)

wherein each $R^1$ is independently selected from the group consisting of linear, branched or cyclic alkyl groups having from 1 to 20 carbon atoms; linear, branched or cyclic alkenyl groups having from 2 to 20 carbon atoms; aryl groups having from 6 to 20 carbon atoms; alkylaryl groups having from 7 to 20 carbon atoms; arylalkyl and arylalkenyl groups having from 7 to 20 carbon atoms and combinations thereof selected from the group consisting of linear, branched or cyclic alkyl groups having from 1 to 20 carbon atoms; linear, branched or cyclic alkenyl groups having from 2 to 20 carbon atoms; aryl groups having from 6 to 20 carbon atoms; alkylaryl groups having from 7 to 20 carbon atoms; arylalkyl; arylalkenyl groups having from 7 to 20 carbon atoms and wherein the index w has a value such that the viscosity of the nitrogen-free silicone polymer is between 0.01 $m^2/s$ (10,000 centistokes at 20° C.) to 2.0 $m^2/s$ (2,000,000 centistokes at 20° C.), more preferably from 0.05 $m^2/s$ (50,000 centistokes at 20° C.) to 1.0 $m^2/s$ (1,000,000 centistokes at 20° C.).

More preferably, the non-functionalized silicone is selected from linear nonionic silicones having the Formulae (I), wherein $R^1$ is selected from the group consisting of methyl, phenyl, and phenylalkyl, most preferably methyl.

Non-limiting examples of nitrogen-free silicone polymers of Formula (I) include the Silicone 200 fluid series from Dow Corning and Baysilone Fluids M 600,000 and 100,000 from Bayer AG.

b3) Silicone Blend

The blend of functionalized and non-functionalized silicones can be formed by simply admixing these two types of silicones together in the appropriate desired ratios. Silicone materials of these two essential types are preferably miscible liquids when their compositions are as specified herein. The silicone blend then can then be added as is to the detergent compositions herein under agitation to form droplets of the silicone blend within the detergent composition.

Generally the weight ratio of functionalized polysiloxane material to non-functionalized polysiloxane material in the silicone blend will range from 100:1 to 1:100. More preferably the blend will contain functionalized and non-functionalized silicones in a weight ratio of from 1:25 to 5:1, even more preferably from 1:20 to 1:1, and most preferably from 1:15 to 1:2.

The blends of functionalized and non-functionalized polysiloxanes used in the detergent compositions herein are preferably also "miscible." For purposes of this invention, such silicone blends are "miscible" if they mix freely and exhibit no phase separation at 20° C. when admixed within the broad weight ratio range of from 100:1 to 1:100.

The silicone blends present as droplets in the liquid detergent can get into the liquid detergent composition formulation in a number of different ways provided that the two essential silicones are mixed before adding them to the balance of the liquid detergent composition. They can be mixed "neat" to form the blend, or, more preferably, the silicone blends can be introduced into the liquid detergent being added as "silicone emulsions". "Silicone emulsions"

herein, unless otherwise made clear, refers to combinations of the blended essential silicones with water plus other adjuncts such as emulsifiers, biocides, thickeners, solvents and the like. The silicone emulsions can be stable, in which case they are useful articles of commerce, practically convenient to handle in the detergent plant, and can be transported conveniently. The silicone emulsions can also be unstable. For example, a temporary silicone emulsion of the blended silicones can be made from the neat silicones in a detergent plant, and this temporary silicone emulsion can then be mixed with the balance of the liquid detergent provided that a dispersion of the droplets having the particle sizes specified herein is the substantially uniform result. (When referring to percentages of ingredients in the liquid detergents, the convention will be used herein of accounting only the essential silicones in the "silicone blend" part of the composition, with all minor ingredients e.g., emulsifiers, biocides, solvents and the like, being accounted for in conjunction with recital of the non-silicone component levels of the formulation.)

In a preferred embodiment of the present invention, the silicone blend is emulsified with water and an emulsifier to form an emulsion which can be used as a separate component of the detergent composition. Such a preformed oil-in-water emulsion can then be added to the other ingredients to form the final liquid laundry detergent composition of the present invention.

The weight ratio of the silicone blend to the emulsifier is generally between 500:1 and 1:50, more preferably between 200:1 and 1:1, and most preferably greater than 2:1. The concentration of the silicone blend in the oil-in-water emulsion will generally range from 5% to 60% by weight of the emulsion, more preferably from 35% to 50% by weight of the emulsion. Preferred silicone blend emulsions for convenient transportation from a silicone manufacturing facility to a liquid detergent manufacturing facility will typically contain these amounts of silicone, with the balance of suitable transportation blends being water, emulsifiers and minor components such as bacteriostats. In such compositions the weight ratio of the silicone blend to water will generally lie in the range from 1:50 to 10:1, more preferably from 1:0 to 1:1.

Any emulsifier which is chemically and physically compatible with all other ingredients of the compositions of the present invention is suitable for use therein and in general the emulsifier can have widely ranging HLB, for example an HLB from 1 to 100. Typically the HLB of the emulsifier will lie in the range from 2 to 20. Cationic emulsifiers, nonionic emulsifiers and mixtures thereof are useful herein. Emulsifiers may also be silicone emulsifiers or non-silicone emulsifiers. Useful emulsifiers also include two- and three-component emulsifier mixtures. The invention includes embodiments wherein two emulsifiers or three emulsifiers are added in forming the silicone blends.

Nonionic Emulsifiers:

One type of nonionic emulsifier suitable for use herein comprises the "common" polyether alkyl nonionics. These include alcohol ethoxylates such as Neodol 23-5 ex Shell and Slovasol 458 ex Sasol. Other suitable nonionic emulsifiers include alkyl poly glucoside-based emulsifiers such as those disclosed in U.S. Pat. No. 4,565,647, Llenado, issued Jan. 21, 1986, having a hydrophobic group containing from 6 to 30 carbon atoms, preferably from 8 to 16 carbon atoms, more preferably from 10 to 12 carbon atoms, and a polysaccharide, e.g. a polyglycoside, hydrophilic group containing from 1.3 to 10, preferably from 1.3 to 3, most preferably from 1.3 to 2.7 saccharide units. Any reducing saccharide containing 5 or 6 carbon atoms can be used, e.g., glucose, galactose and galactosyl moieties can be substituted for the glucosyl moieties (optionally the hydrophobic group is attached at the 2-, 3-, 4-, etc. positions thus giving a glucose or galactose as opposed to a glucoside or galactoside). The intersaccharide bonds can be, e.g., between the one position of the additional saccharide units and the 2-, 3-, 4-, and/or 6-positions on the preceding saccharide units.

Preferred alkylpolyglycosides have the formula $$R^2O(C_nH_{2n}O)_t(\text{glycosyl})_x$$

wherein $R^2$ is selected from the group consisting of alkyl, alkylphenyl, hydroxyalkyl, hydroxyalkylphenyl, and combinations thereof in which the alkyl groups contain from 6 to 30, preferably from 8 to 16, more preferably from 10 to 12 carbon atoms; n is 2 or 3, preferably 2; t is from 0 to 10, preferably 0; and x is from 1.3 to 10, preferably from 1.3 to 3, most preferably from 1.3 to 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominately the 2-position. Compounds of this type and their use in detergents are disclosed in EP-B 0 070 077, 0 075 996, 0 094 118, and in WO 98/00498.

Still other types of useful nonionic emulsifiers for making silicone blend emulsions include other polyol surfactants such as sorbitan esters (e.g. Span 80 ex Uniqema, Crill 4 ex Croda) and ethoxylated sorbitan esters. Polyoxyethylene fatty acid esters (e.g. Myrj 59 ex Uniqema) and ethoxylated glycerol esters may also be used as can fatty amides/amines and ethoxylated fatty amides/amines.

Cationic Emulsifiers:

Cationic emulsifiers suitable for use in the silicone blends of the present invention have at least one quaternized nitrogen and one long-chain hydrocarbyl group. Compounds comprising two, three or even four long-chain hydrocarbyl groups are also included. Examples of such cationic emulsifiers include alkyltrimethylammonium salts or their hydroxyalkyl substituted analogs, preferably compounds having the formula $R^1R^2R^3R^4N^+X^-$. $R^1$, $R^2$, $R^3$ and $R^4$ are independently selected from $C_1$-$C_{26}$ alkyl, alkenyl, hydroxyalkyl, benzyl, alkylbenzyl, alkenylbenzyl, benzylalkyl, benzylalkenyl and X is an anion. The hydrocarbyl groups $R^1$, $R^2$, $R^3$ and $R^4$ can independently be alkoxylated, preferably ethoxylated or propoxylated, more preferably ethoxylated with groups of the general formula $(C_2H_4O)_xH$ where x has a value from 1 to 15, preferably from 2 to 5. Not more than one of $R^2$, $R^3$ or $R^4$ should be benzyl. The hydrocarbyl groups $R^1$, $R^2$, $R^3$ and $R^4$ can independently comprise one or more, preferably two, ester-([—O—C(O)—]; [—C(O)—O—]) and/or an amido-groups ([O—N(R)—]; [—N(R)—O—]) wherein R is defined as $R^1$ above. The anion X may be selected from halide, methysulfate, acetate and phosphate, preferably from halide and methylsulfate, more preferably from chloride and bromide. The $R^1$, $R^2$, $R^3$ and $R^4$ hydrocarbyl chains can be fully saturated or unsaturated with varying Iodine value, preferably with an Iodine value of from 0 to 140. At least 50% of each long chain alkyl or alkenyl group is predominantly linear, but also branched and/or cyclic groups are included.

For cationic emulsifiers comprising only one long hydrocarbyl chain, the preferred alkyl chain length for $R^1$ is $C_{12}$-$C_{15}$ and preferred groups for $R^2$, $R^3$ and $R^4$ are methyl and hydroxyethyl.

For cationic emulsifiers comprising two or three or even four long hydrocarbyl chains, the preferred overall chain length is $C_{18}$, though combinations of chain lengths having non-zero proportions of lower, e.g., $C_{12}$, $C_{14}$, $C_{16}$ and some higher, e.g., $C_{20}$ chains can be quite desirable.

Preferred ester-containing emulsifiers have the general formula $$\{(R_5)_2N((CH_2)_nER_6)_2\}^+X^-$$

wherein each $R_5$ group is independently selected from $C_{1-4}$ alkyl, hydroxyalkyl or $C_{2-4}$ alkenyl; and wherein each $R_6$ is independently selected from $C_{8-28}$ alkyl or alkenyl groups; E is an ester moiety i.e., —OC(O)— or —C(O)O—, n is an integer from 0 to 5, and $X^-$ is a suitable anion, for example chloride, methosulfate and combinations thereof.

A second type of preferred ester-containing cationic emulsifiers can be represented by the formula: $\{(R_5)_3N(CH_2)_nCH(O(O)CR_6)CH_2O(O)CR_6\}^+X^-$ wherein $R_5$, $R_6$, X, and n are defined as above. This latter class can be exemplified by 1,2 bis[hardened tallowoyloxy]-3-trimethylammonium propane chloride.

The cationic emulsifiers, suitable for use in the blends of the present invention can be either water-soluble, water-dispersible or water-insoluble.

Silicone Emulsifiers:

Silicone emulsifiers useful herein are nonionic, do not include any nitrogen, and do not include any of the non-functionalized silicones described hereinbefore. Silicone emulsifiers are described for example in "Silicone Surfactants" in the Surfactant Science Series, Volume 86 (Editor Randal M. Hill), Marcel Dekker, NY, 1999. See especially Chapter 2, "Silicone Polyether Copolymers: Synthetic Methods and Chemical Compositions and Chapter 1, "Siloxane Surfactants".

Especially suitable silicone emulsifiers are polyalkoxylated silicones corresponding to those of the structural Formula I set forth hereinbefore wherein $R^1$ is selected from the definitions set forth hereinbefore and from poly(ethyleneoxide/propyleneoxide) copolymer groups having the general formula (II):

$$—(CH_2)_nO(C_2H_4O)_c(C_3H_6O)_dR^3 \quad (II)$$

with at least one $R^1$ being such a poly(ethyleneoxy/propyleneoxy) copolymer group, and each $R^3$ is independently selected from the group consisting of hydrogen, an alkyl having 1 to 4 carbon atoms, and an acetyl group; and wherein the index w has a value such that the viscosity of the resulting silicone emulsifier ranges from 0.00002 $m^2$/sec to 0.2 $m^2$/sec.

Emulsifier Diluents:

The emulsifier may also optionally be diluted with a solvent or solvent system before emulsification of the silicone blend. Typically, the diluted emulsifier is added to the pre-formed silicone blend. Suitable solvents can be aqueous or non-aqueous; and can include water alone or organic solvents alone and/or combinations thereof. Preferred organic solvents include monohydric alcohols, dihydric alcohols, polyhydric alcohols, ethers, alkoxylated ethers, low-viscosity silicone-containing solvents such as cyclic dimethyl siloxanes and combinations thereof. Preferred are glycerol, glycols, polyalkylene glycols such as polyalkylene glycols, dialkylene glycol mono $C_1$-$C_8$ ethers and combinations thereof. Even more preferred are diethylene glycol mono ethyl ether, diethylene glycol mono propyl ether, diethylene glycol mono butyl ether, and combinations thereof. Highly preferred are combinations of solvents, especially combinations of lower aliphatic alcohols such as ethanol, propanol, butanol, isopropanol, and/or diols such as 1,2-propanediol or 1,3-propanediol; or combinations thereof with dialkylene glycol mono $C_1$-$C_8$ ethers and/or glycols and/or water. Suitable monohydric alcohols especially include $C_1$-$C_4$ alcohols.

b4) Silicone Blend in Deterrent Composition

The silicone blend as hereinbefore described will generally comprise from 0.05% to 10% by weight of the liquid detergent composition. More preferably, the silicone blend will comprise from 0.1% to 5.0%, even more preferably from 0.25% to 3.0%, and most preferably from 0.5% to 2.0%, by weight of the liquid detergent composition. The silicone blend will generally be added to some or all of the other liquid detergent composition components under agitation to disperse the blend therein.

Within the liquid detergent compositions herein, the silicone blend, either having added emulsifiers present or absent, will be present in the form of droplets. Within the detergent composition, and within emulsions formed from the silicone blend, such droplets will generally have a median silicone particle size of from 0.5 μm to 300 μm, more preferably from 0.5 μm to 100 μm and even more preferably from 0.6 μm to 50 μm. As indicated, particle size may be measured by means of a laser scattering technique, using a Coulter LS 230 Laser Diffraction Particle Size Analyser from Coulter Corporation, Miami, Fla., 33196, USA). Particle sizes are measured in volume weighted % mode, calculating the median particle size. Another method which can be used for measuring the particle size is by means of a microscope, using a microscope manufactured by Nikon® Corporation, Tokyo, Japan; type Nikon® E-1000 (enlargement 700×).

C) Aqueous Base and Non-Silicone Laundry Adjunct

The liquid detergent compositions of the present invention must contain water as well as an additional non-silicone laundry adjunct selected from detersive enzymes, dye transfer inhibiting agents, optical brighteners, suds suppressors, and combinations thereof.

c1) Water

The liquid detergent compositions herein are aqueous in nature. Accordingly, the detergent compositions herein will contain at least 4% by weight of water. More preferably such compositions will contain at least 20% by weight of water, even more preferably at least 50% by weight of water.

c2) Enzymes—The laundry adjuncts may also comprise one or more detersive enzymes. Suitable detersive enzymes for use herein include: Proteases like subtilisins from *Bacillus* [e.g. subtilis, lentus, licheniformis, amyloliquefaciens (BPN, BPN'), alcalophilus,] e.g. Esperase®), Alcalase®, Everlase® and Savinase® (Novozymes), BLAP and variants [Henkel]. Further proteases are described in EP130756, WO91/06637, WO95/10591 and WO99/20726. Amylases (α and/or β) are described in WO 94/02597 and WO 96/23873. Commercial examples are Purafect Ox Am® [Genencor] and Termamyl®, Natalase®, Ban®, Fungamyl® and Duramyl® [all ex Novozymes]. Cellulases include bacterial or fungal cellulases, e.g. produced by *Humicola insolens*, particularly DSM 1800, e.g. 50 Kda and ~43 kD [Carezyme®]. Also suitable cellulases are the EGIII cellulases from *Trichoderma longibrachiatum*. Suitable lipases include those produced by *Pseudomonas* and *Chromobacter* groups. Preferred are e.g. Lipolase®, Lipolase Ultra®, Lipoprime® and Lipex® from Novozymes. Also suitable are cutinases [EC 3.1.1.50] and esterases. Carbohydrases e.g. mannanase (U.S. Pat. No. 6,060,299), pectate lyase (WO99/27083) cyclomaltodextringlucanotransferase (WO96/33267) xyloglucanase (WO99/02663). Bleaching enzymes eventually with enhancers include e.g. peroxidases, laccases, oxygenases, (e.g. catechol 1,2 dioxygenase, lipoxygenase (WO 95/26393), (non-heme) haloperoxidases.

It is common practice to modify wild-type enzymes via protein/genetic engineering techniques in order to optimize their performance in the detergent compositions. If used, these enzymes are typically present at concentrations from 0.0001% to 2.0%, preferably from 0.0001% to 0.5%, and more preferably from 0.005% to 0.1%, by weight of pure enzyme (weight % of composition).

Enzymes can be stabilized using any known stabilizer system like calcium and/or magnesium compounds, boron compounds and substituted boric acids, aromatic borate esters, peptides and peptide derivatives, polyols, low molecular weight carboxylates, relatively hydrophobic organic compounds [e.g. certain esters, dialkyl glycol ethers, alcohols or alcohol alkoxylates], alkyl ether carboxylate in addition to a calcium ion source, benzamidine hypochlorite, lower aliphatic alcohols and carboxylic acids, N,N-bis(carboxymethyl) serine salts; (meth)acrylic acid-(meth)acrylic acid ester copolymer and PEG; lignin compound, polyamide oligomer, glycolic acid or its salts; poly hexamethylene bi guanide or N,N-bis-3-amino-propyl-dodecyl amine or salt; and combinations thereof.

In liquid matrix of the compositions of the present invention, the degradation by the proteolytic enzyme of second enzymes can be avoided by protease reversible inhibitors [e.g. peptide or protein type, in particular the modified subtilisin inhibitor of family VI and the plasminostrepin; leupeptin, peptide trifluoromethyl ketones, peptide aldehydes.

c3) Dye transfer inhibiting agents—The laundry adjuncts may also comprise one or more materials effective for inhibiting the transfer of dyes from one fabric to another. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and combinations thereof. If used, these agents typically are present at concentrations from 0.01% to 10%, preferably from 0.01% to 5%, and more preferably from 0.05% to 2%, by weight of the composition.

More specifically, the polyamine N-oxide polymers preferred for use herein contain units having the following structural formula: R-$A_x$-Z; wherein Z is a polymerizable unit to which an N—O group can be attached or the N—O group can form part of the polymerizable unit or the N—O group can be attached to both units; A is one of the following structures: —NC(O)—, —C(O)O—, —S—, —O—, —N═; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof.

The N—O group can be represented by the following general structures:

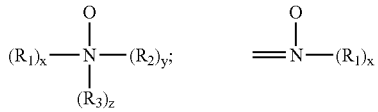

wherein $R_1$, $R_2$, $R_3$ are aliphatic, aromatic, heterocyclic or alicyclic groups or combinations thereof, x, y and z are 0 or 1; and the nitrogen of the N—O group can be attached or form part of any of the aforementioned groups. The amine oxide unit of the polyamine N-oxides has a pKa <10, preferably pKa <7, more preferred pKa <6.

Any polymer backbone can be used as long as the amine oxide polymer formed is water-soluble and has dye transfer inhibiting properties. Examples of suitable polymeric backbones are polyvinyls, polyalkylenes, polyesters, polyethers, polyamide, polyimides, polyacrylates and combinations thereof. These polymers include random or block copolymers where one monomer type is an amine N-oxide and the other monomer type is an N-oxide. The amine N-oxide polymers typically have a ratio of amine to the amine N-oxide of 10:1 to 1:1,000,000. However, the number of amine oxide groups present in the polyamine oxide polymer can be varied by appropriate copolymerization or by an appropriate degree of N-oxidation. The polyamine oxides can be obtained in almost any degree of polymerization. Typically, the average molecular weight is within the range of 500 to 1,000,000; more preferred 1,000 to 500,000; most preferred 5,000 to 100,000. This preferred class of materials can be referred to as "PVNO".

The most preferred polyamine N-oxide useful in the present compositions and processes for carrying out domestic laundry herein is poly(4-vinylpyridine-N-oxide) which as an average molecular weight of 50,000 and an amine to amine N-oxide ratio of 1:4.

Copolymers of N-vinylpyrrolidone and N-vinylimidazole polymers (referred to as a class as "PVPVI") are also preferred for use herein. Preferably the PVPVI has an average molecular weight range from 5,000 to 1,000,000, more preferably from 5,000 to 200,000, and most preferably from 10,000 to 20,000. (The average molecular weight range is determined by light scattering as described in Barth, et al., *Chemical Analysis*, Vol 113. "Modern Methods of Polymer Characterization", the disclosures of which are incorporated herein by reference.) The PVPVI copolymers typically have a molar ratio of N-vinylimidazole to N-vinylpyrrolidone from 1:1 to 0.2:1, more preferably from 0.8:1 to 0.3:1, most preferably from 0.6:1 to 0.4:1. These copolymers can be either linear or branched.

The present compositions also may employ a polyvinylpyrrolidone ("PVP") having an average molecular weight of from 5,000 to 400,000, preferably from 5,000 to 200,000, and more preferably from 5,000 to 50,000. PVP's are known to persons skilled in the detergent field; see, for example, EP-A-262,897 and EP-A-256,696. Compositions containing PVP can also contain polyethylene glycol ("PEG") having an average molecular weight from 500 to 100,000, preferably from 1,000 to 10,000. Preferably, the ratio of PEG to PVP on a ppm basis delivered in wash solutions is from 2:1 to 50:1, and more preferably from 3:1 to 10:1.

c4) Optical Brighteners

The compositions herein may comprise from 0.01% to 2.0% by weight of an optical brightener. Suitable optical brighteners include stilbene brighteners. Stilbene brighteners are aromatic compounds with two aryl groups separated by an alkylene chain. Optical brighteners are described in greater detail in U.S. Pat. Nos. 4,309,316; 4,298,490; 5,035,825 and 5,776,878.

c5) Suds Suppressors

The compositions may comprise a suds suppressing system present at a level of from 0.01% to 15%, preferably from 0.1% to 5% by weight of the composition. Suitable suds suppressing systems for use herein may comprise any known antifoam compound, including silicone-based antifoam compounds and 2-alkyl alcanol antifoam compounds. Preferred silicone antifoam compounds are generally compounded with silica and include the siloxanes, particularly the polydimethylsiloxanes having trimethylsilyl end blocking units. Other suitable antifoam compounds include the monocarboxylic fatty acids and soluble salts thereof, which are described in U.S. Pat. No. 2,954,347. A preferred particulate suds suppressing system is described in EP-A-0210731. A preferred suds suppressing system in particulate form is described in EP-A-0210721.

D) Optional Coacervate Phase-Forming Polymer or Cationic Deposition Aid

The liquid laundry detergent compositions of the present invention may optionally contain up to 1% by weight, more preferably from 0.01% to 0.5% by weight of a coacervate phase-forming polymer or cationic deposition aid. Alternatively the compositions herein may be essentially free of such a coacervate former or cationic deposition aid. Essentially free means less than 0.01%, preferably less than 0.005%, more preferably less than 0.001% by weight of the composition, and most preferably completely or totally free of any coacervate phase-forming polymer and of any cationic deposition aid.

For purposes of this invention, a coacervate phase-forming polymer is any polymer material which will react, interact, complex or coacervate with any of the composition components to form a coacervate phase. The phrase "coacervate phase" includes all kinds of separated polymer phases known by the person skilled in the art such as disclosed in L. Piculell & B. Lindman, Adv. Colloid Interface Sci., 41 (1992) and in B. Jonsson, B. Lindman, K. Holmberg, & B. Kronberb, "Surfactants and Polymers In Aqueous Solution", John Wiley & Sons, 1998. The mechanism of coacervation and all its specific forms are fully described in "Interfacial Forces in Aqueous Media", C. J. van Oss, Marcel Dekker, 1994, pages 245 to 271. When using the phrase "coacervate phase", it should be understood that such a term is also occasionally referred to as "complex coacervate phase" or as "associated phase separation" in the literature.

Also for purpose of this invention, a cationic deposition aid is a polymer which has cationic, functional substituents and which serve to enhance or promote the deposition onto fabrics of one or more fabric care agents during laundering operations. Many but not all cationic deposition aids are also coacervate phase-forming polymers.

Typical coacervate phase-forming polymers and any cationic deposition aids are homopolymers or can be formed from two or more types of monomers. The molecular weight of the polymer will generally be between 5,000 and 10,000,000, typically at least 10,000 and more typically in the range 100,000 to 2,000,000. Coacervate phase-forming polymers and cationic deposition aids typically have cationic charge densities of at least 0.2 meq/gm at the pH of intended use of the composition, which pH will generally range from pH 3 to pH 9, more generally between pH 4 and pH 8. The coacervate phase-forming polymers and any cationic deposition aids are typically of natural or synthetic origin and selected from the group consisting of substituted and unsubstituted polyquaternary ammonium compounds, cationically modified polysaccharides, cationically modified (meth)acrylamide polymers/copolymers, cationically modified (meth) acrylate polymers/copolymers, chitosan, quaternized vinylimidazole polymers/copolymers, dimethyldiallylammonium polymers/copolymers, polyethylene imine based polymers, cationic guar gums, and derivatives thereof and combinations thereof.

These polymers may have cationic nitrogen containing groups such as quaternary ammonium or protonated amino groups, or a combination thereof. The cationic nitrogen-containing group are generally be present as a substituent on a fraction of the total monomer units of the cationic polymer. Thus, when the polymer is not a homopolymer it will frequently contain spacing non-cationic monomer units. Such polymers are described in the CTFA Cosmetic Ingredient Directory, $7^{th}$ edition.

Non-limiting examples of included, excluded or minimized coacervate phase-forming cationic polymers include copolymers of vinyl monomers having cationic protonated amine or quaternary ammonium functionalities with water soluble spacer monomers such as acrylamide, methacrylamide, alkyl and dialkyl acrylamides, alkyl and dialkyl methacrylamides, alkyl acrylate, alkyl methacrylate, vinyl caprolactone and vinyl pyrrolidine. The alkyl and dialkyl substituted monomers typically have $C_1$-$C_7$ alkyl groups, more typically $C_1$-$C_3$ alkyl groups. Other spacers include vinyl esters, vinyl alcohol, maleic anhydride, propylene glycol and ethylene glycol.

Other included, excluded or minimized coacervate phase-forming cationic polymers include, for example: a) copolymers of 1-vinyl-2-pyrrolidine and 1-vinyl-3-methyl-imidazolium salt (e.g. chloride alt), referred to in the industry by the Cosmetic, Toiletry, and Fragrance Association, (CTFA) as Polyquaternium-16. This material is commercially available from BASF Wyandotte Corp. under the LUVIQUAT tradenname (e.g. LUVIQUAT FC 370); b) copolymers of 1-vinyl-2-pyrrolidine and dimethylaminoethyl methacrylate, referred to in the industry (CTFA) as Polyquaternium-11. This material is available commercially from Graf Corporation (Wayne, N.J., USA) under the GAFQUAT tradename (e.g. GAFQUAT 755N); c) cationic diallyl quaternary ammonium-containing polymers including, for example, dimethyldiallylammonium chloride homopolymer and copolymers of acrylamide and dimethyldiallylammonium chloride, reffered to in the industry (CTFA) as Polyquaternium 6 and Polyquaternium 7, respectively; d) mineral acid salts of amino-alkyl esters of homo- and copolymers of unsaturated carboxylic acids having from 3 to 5 carbon atoms as describes in U.S. Pat. No. 4,009,256; e) amphoteric copolymers of acrylic acid including copolymers of acrylic acid and dimethyldiallylammonium chloride (referred to in the industry by CTFA as Polyquaternium 22), terpolymers of acrylic acid with dimethyldiallylammonium chloride and acrylamide (referred to in the industry by CTFA as Polyquaternium 39), and terpolymers of acrylic acid with methacrylamidopropyl trimethylammonium chloride and methylacrylate (referred to in the industry by CTFA as Polyquaternium 47).

Other included, excluded or minimized coacervate phase-forming polymers and any cationic deposition aids include cationic polysaccharide polymers, such as cationic cellulose and derivatives thereof, cationic starch and derivatives thereof, and cationic guar gums and derivatives thereof.

Cationic polysaccharide polymers include those of the formula:

$$A\text{-}O\text{-}[R\text{—}N^{+}(R^{1})(R^{2})(R^{3})]X^{-}$$

wherein A is an anhydroglucose residual group, such as a starch or cellulose anhydroglucose residual, R is an alkylene, oxyalkylene, polyoxyalkylene, or hydroxyalkylene group, or combination thereof; and $R^1$, $R^2$, and $R^3$ independently represent alkyl, aryl, alkylaryl, arylalkyl, alkoxyalkyl, or alkoxyaryl, each group comprising up to 18 carbon atoms. The total number of carbon atoms for each cationic moiety (i.e. the sum of carbon atoms in $R^1$, $R^2$, and $R^3$) is typically 20 or less, and X is an anionic counterion as described hereinbefore.

A particular type of commercially utilized cationic polysaccharide polymer is a cationic guar gum derivative, such as the cationic polygalactomannan gum derivatives described in U.S. Pat. No. 4,298,494, which are commercially available from Rhone-Poulenc in their JAGUAR tradename series. An example of a suitable material is hydroxypropyltrimonium chloride of the formula:

$$G\text{—}O\text{—}CH_2\text{—}\underset{\underset{OH}{|}}{CH}\text{—}CH_2\text{—}N^{+}\text{—}(CH_3)_3 \quad X^{-}$$

where G represents guar gum, and X is an anionic counterion as described hereinbefore, typically chloride. Such a material is available under the tradename of JAGUAR C-13-S. In JAGUAR C-13-S the cationic charge density is 0.7 meq/gm. Similar cationic guar gums are also available from AQUALON under the tradename of N-Hance® 3196 and Galactosol® SP813S.

Still other types of cationic celloulosic deposition aids are those of the general structural formula:

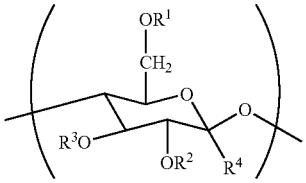

wherein $R^1$, $R^2$, $R^3$ are each independently H, $CH_3$, $C_{8-24}$ alkyl (linear or branched), $$\text{—}(CH_2\overset{\overset{R^5}{|}}{C}H\text{—}O)_n\text{—}Rx$$

or mixtures thereof; wherein n is from about 1 to about 10; Rx is H, $CH_3$, $C_{8-24}$ alkyl (linear or branched), $$\text{—}CH_2\overset{\overset{OH}{|}}{C}HCH_2\text{—}\underset{\underset{R^8}{|}}{\overset{\overset{R^7}{|}}{N^{+}}}\text{—}R^9Z$$

or mixtures thereof, wherein Z is a chlorine ion, bromine ion, or mixture thereof; $R^5$ is H, $CH_3$, $CH_2CH_3$, or mixtures thereof, $R^7$ is $CH_3$, $CH_2CH_3$, a phenyl group, a $C_{8-24}$ alkyl group (linear or branched), or mixture thereof, and $R^8$ and $R^9$ are each independently $CH_3$, $CH_2CH_3$, phenyl, or mixtures thereof:

$R^4$ is H, $$\text{—}(P)_m\text{—}H,$$

or mixtures thereof wherein P is a repeat unit of an addition polymer formed by radical polymerization of a cationic monomer

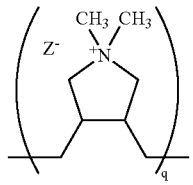

wherein Z' is a chlorine ion, bromine ion or mixtures thereof and q is from about 1 to about 10.

Cationic cellulosic deposition aids of this type are described more fully in WO 04/022686. Reference is also made to "Principles of Polymer Science and Technology in Cosmetics and Personal Care" by Goddard and Gruber and in particular to pages 260-261, where an additional list of synthetic cationic polymers to be included, excluded or minimized can be found.

E) Other Optional Composition Components—

The present compositions may optionally comprise one or more optional composition components, such as liquid carriers, detergent builders and chelating agents including organic carboxylate builders such as citrate and fatty acid salts, stabilizers and structurants such as hydrogenated castor oil and its derivatives, coupling agents, fabric substantive perfumes, cationic nitrogen-containing detersive surfactants, pro-perfumes, bleaches, bleach activators, bleach catalysts, enzyme stabilizing systems, soil release polymers, dispersants or polymeric organic builders including water-soluble polyacrylates, acrylate/maleate copolymers and the like, dyes, colorants, filler salts such as sodium sulfate, hydrotropes such as toluenesulfonates, cumenesulfonates and naphthalenesulfonates, photoactivators, hydrolyzable surfactants, preservatives, anti-oxidants, anti-shrinkage agents, anti-wrinkle agents, germicides, fungicides, color speckles, colored beads, spheres or extrudates, sunscreens, fluorinated compounds, clays, pearlescent agents, luminescent agents or chemiluminescent agents, anti-corrosion and/or appliance protectant agents, alkalinity sources or other pH adjusting agents, solubilizing agents, carriers, processing aids, pigments, free radical scavengers, and pH control agents. Suitable materials include those described in U.S. Pat. Nos. 5,705,464, 5,710,115, 5,698,504, 5,695,679, 5,686,014 and 5,646,101.

F) Process for Preparing the Liquid Detergent Compositions

The liquid detergent compositions of the present invention can be prepared in any suitable manner and can, in general, involve any order of combining or addition as known by the person skilled in the art. As indicated, the silicone blend is generally preformed and then added to the balance of the liquid detergent components.

EXAMPLES

The following non-limiting examples are illustrative of the present invention.

The final liquid laundry detergent composition is formulated by combining a pre-formed silicone blend, which is optionally emulsified with an emulsifier, with at least one surfactant and further at least one additional requisite non-silicone laundry adjunct. The surfactant and the laundry adjunct may optionally pre-mixed prior to combination with the, optionally emulsified, pre-formed silicone blend.

Fabric Cleaning Premixes A1 and A2 and A3:

| | wt % (raw materials at 100% activity) | | |
|---|---|---|---|
| | A1 | A2 | A3 |
| $C_{13}$-$C_{15}$ alkylbenzene sulphonic acid | 13.0 | 5.5 | 5.5 |
| $C_{12}$-$C_{15}$ alkyl ethoxy (1.1 eq.) sulphate | | 13.0 | 13.0 |
| $C_{14}$-$C_{15}$ EO8 (1) | 9.0 | — | — |
| $C_{12}$-$C_{13}$ EO9 (2) | — | 2.0 | 2.0 |
| $C_{12}$-$C_{14}$ alkyl dimethyl amineoxide (3) | 1.5 | 1.0 | 1.0 |
| $C_{12}$-$C_{18}$ fatty acid | 10.0 | 2.0 | 2.0 |
| Citric acid | 4.0 | 4.0 | 4.0 |
| Diethylene triamine pentamethylene phosphonic acid | 0.3 | — | — |
| Hydroxyethane dimethylene phosphonic acid | 0.1 | — | — |
| Ethoxylated polyethylene imine | 1.0 | 1.0 | 1.0 |
| Ethoxylated tetraethylene pentamine | 1.0 | 0.5 | 0.5 |
| Di Ethylene Triamine Penta acetic acid | — | 0.5 | 0.5 |
| Ethoxysulphated hexamethylene diamine quat | — | 1.0 | 1.0 |
| Fluorescent whitening agent | 0.15 | 0.15 | 0.15 |
| $CaCl_2$ | 0.02 | 0.02 | 0.02 |
| Propanediol | 5.0 | 6.5 | 6.5 |
| Ethanol | 2.0 | 2.0 | 2.0 |
| Sodium cumene sulphonate | 2.0 | — | — |
| NaOH | to pH 7.8 | to pH 8.0 | to pH 8.0 |
| Protease enzyme | 0.75 | 0.75 | 0.75 |
| Amylase enzyme | 0.20 | 0.20 | 0.20 |
| Cellulase enzyme | 0.05 | — | — |
| Boric acid | 2.0 | 0.3 | — |
| Na-Borate | — | — | 1.5 |
| Poly(N-vinyl-2-pyrrolidone)-poly(N-vinyl-imidazol) (MW: 35,000) | 0.1 | — | — |
| JR400 Cationic Cellulose Ether (4) | — | — | 0.15 |
| Tinopal ®-AMS-GX | — | 1.2 | — |
| Hydrogenated castor oil | 0.2 | 0.3 | 0.3 |
| Dye | 0.001 | 0.001 | 0.001 |
| Perfume | 0.70 | 0.70 | 0.70 |
| Water | Balance | Balance | Balance |

(1) Marlipal 1415/8.1 ex Sasol
(2) Neodol 23-9 ex Shell
(3) $C_{12}$-$C_{14}$ alkyl dimethyl amineoxide ex P&G, supplied as a 31% active solution in water
(4) Dow Chemical - Falls within cationic cellulose structural formula hereinbefore set forth. Swollen with water prior to addition to the premix.

Preparation of Amino-Polysiloxane for the Silicone Blend

1) Preparation of Precursor High in Amino Groups 1,003.3 g (3.86 mol) of aminoethylaminopropylmethyldimethoxysilane, 1,968 g of a siloxane of the composition M2D25 and 29.7 g of a 10% strength solution of KOH in methanol are mixed with one another in a four-necked flask at room temperature, while stirring. 139 g (7.72 mol) of deionized water are added dropwise to the cloudy mixture, and the temperature rises to 46° C. The temperature is increased stepwise to 125° C. in the course of 3 hours, with a methanol-containing distillate (363 g) being removed from 80° C. After cooling back to 116° C., 139 g of water are again added and the temperature is subsequently increased to 150° C. in the course of 3 hours, with 238 g of distillate being obtained. After renewed cooling back to 110° C., addition of 139 g of water and heating to 150° C. in the course of 3 hours, 259 g of distillate are obtained. Finally, the constituents which boil up to 150° C. under an oil vacuum are removed (123 g). 2,383 g of a yellow, clear oil are obtained.

The product obtained is analyzed for reactive group content using NMR spectroscopy methods. Such methods involve the following parameters:

1) Instrument Type: Bruker DPX400 NMR spectrometer
2) Frequency: 400 MHz
3) Standard: Tetramethylsilane (TMS)
4) Solvent: CDC13 (deuterated chloroform)
5) Concentration: for H-1 0.2%; for Si-29 20%
6 Pulse Sequence: ZGIZ™ (Bruker) for Si-29-nmr spectra with 10 second relaxation delay time Using NMR having these characteristics, the following analysis is obtained:

$$M_{1.95}D^{OH}_{0.025}D^{OCH3}_{0.025}D^{*}_{7.97}D_{36.9}$$

where $D^{*}=SiCH_2CH_2CH_2NHCH_2CH_2NH_2$.

2) Preparation of Aminosilicone with Low Reactive/Curable Group Content 200.6 g (47.7 mmol) of the precursor high in amino groups as prepared in Step 1); 101 g (152.3 mmol) of a siloxane of the composition M2D6.9, 6,321 g of D4 and 1.66 g of 10% strength KOH in ethanol are initially introduced into a four-necked flask at room temperature, while stirring, and the mixture is heated at 180° C. for 3 hours. After cooling back to 120° C., a further 1.66 g of 10% strength KOH in ethanol are added. The mixture is then heated at 180° C. for a further 3 hours (the viscosity of a sample taken at this point in time is 2,940 mPas, 20° C.). A water-pump vacuum is applied at 180° C., so that D4 boils under reflux for 10 minutes. 60 g of D4, which contains included drops of water, are removed in a water separator. This procedure is repeated after 2, 4 and 6 hours. After cooling back to 30° C., 0.36 g of acetic acid is added to neutralize the catalyst. All the constituents which boil up to 150° C. are then removed under an oil vacuum. 5,957 g of a colorless aminosiloxane with a viscosity of 4,470 mPas (20° C.) and the composition, determined by NMR spectroscopy as described above, of $$M_2D^{*}_{2.16}D_{447}$$

where $D^{*}=SiCH_2CH_2CH_2NHCH_2CH_2NH_2$ are obtained. Such a material has a nitrogen content of 0.20% by weight and a percent ratio of terminal curable/reactive groups of essentially 0%.

Preparation of the silicone emulsion (Emulsion E1): 15.0 g of the Step 2 aminosilicone are added to 45.0 g of PDMS 0.6 $m/s^2$ (600,000 centistokes at 20° C.; GE® Visc-600M) and mixed with a normal laboratory blade mixer (type: IKA Labortechnik Eurostar power control-visc lab mixer) for at least 1 hour.

14.3 g of the blend of Step 2 aminosilicone with PDMS 0.6 $m/s^2$ are added to 7.15 g of Neodol 25-3 ex Shell (ethoxylated alcohol nonionic emuslifier) and the mixture is stirred for 15 minutes with a normal laboratory blade mixer (type: IKA Labortechnik Eurostar power control-visc lab mixer) at 250 RPM.

3 equal partitions of 7.14 g water are added with each time 10 minutes stirring at 250 RPM in-between.

A final 7.14 g water is added and the stirring speed is increased to 400 RPM. The mixture is stirred at this speed for 40 minutes.

Preparation of the silicone emulsion (Emulsion E2): 15.0 g of the Step 2 aminosilicone are added to 45.0 g of PDMS 0.6 $m/s^2$ (600,000 centistokes at 20° C.; GE® Visc-600M) and mixed with a normal laboratory blade mixer (type: IKA Labortechnik Eurostar power control-visc lab mixer) for at least 1 hour.

30.0 g of the blend of Step 2 aminosilicone with PDMS 0.6 $m/s^2$ are added to 4.30 g of Crill 4 sorbitan oleate ex Croda and mixed with a normal laboratory blade mixer at 300 RPM for 15 minutes.

11.6 g of Crodet S100 PEG-100 stearate (25% in water) ex Croda are added and the mixture is stirred for 15 minutes at 1000 RPM.

5.1 g water is added dropwise in a time span of 10 minutes, upon stirring at 1000 RPM, and after the addition of the water, the mixture is stirred for another 30 minutes at 1000 RPM.

27.0 g of a 1.45% sodium carboxymethyl cellulose solution are added and the mixture is stirred for 15 minutes at 500 RPM.

Preparation of the silicone emulsion (Emulsion E3): 15.0 g of the Step 2 aminosilicone are added to 45.0 g of PDMS 0.1 $m/s^2$ (100,000 centistokes at 20° C.; GE® Visc-100M) and mixed with a normal laboratory blade mixer (type: IKA Labortechnik Eurostar power control-visc lab mixer) for at least 1 hour.

19.25 g of of the blend of Step 2 aminosilicone with PDMS 0.1 $m/s^2$ is mixed with 1.15 g of Neodol 25-3 ex Shell and 4.6 g of Slovasol 458 ex Sasol (ethoxylated alcohol nonionic) and stirred for 10 minutes at 300 RPM.

10.0 g water is added and the mixture is stirred for 30 minutes at 300 RPM.

3 equal partitions of 5.0 g water are added, with 10 minutes stirring at 300 RPM after each water addition.

Preparation of the silicone emulsion (Emulsion E4): 6.0 g of the Step 2 aminosilicone are added to 54.0 g of PDMS 0.6 $m/s^2$ (600,000 centistokes at 20° C.; GE® Visc-600M) and mixed with a normal laboratory blade mixer (type: IKA Labortechnik Eurostar power control-visc lab mixer) for at least 1 hour.

19.25 g of of the blend of Step 2 aminosilicone with PDMS 0.6 $m/s^2$ is mixed with 4.6 g of Neodol 25-3 ex Shell and 1.15 g of Slovasol 458 ex Sasol and stirred for 10 minutes at 300 RPM.

10.0 g water is added and the mixture is stirred for 30 minutes at 300 RPM.

3 equal partitions of 5.0 g water are added, with 10 minutes stirring at 300 RPM after each water addition.

Final Detergent Compositions

Combination of the two premixes A1 & E1 (Entry 1) or A1 & E2 (Entr 2) or A1 & E3 (Entry 3) or A1 & E4 (Entry 4) or A2 & E1 (Entry 5) or A2 & E2 (Entry 6) or A2 & E3 (Entry 7) or A2 & E4 (Entr 8) or A3 & E1 (Entry 9) or A3 & E2 (Entry 10) or A3 & E3 (Entry 11) or A3 & E4 (Entry 12) to form the final liquid laundry detergent composition:

104.9 g of premix E1 is added to 1500 g of either premixes A1 or A2 or A3 and stirred for 15 min at 350 RPM with a normal laboratory blade mixer.

78.0 g of premix E2 is added to 1500 g of either premixes A1 or A2 or A3 and stirred for 15 min at 350 RPM with a normal laboratory blade mixer.

For all emulsions E1, E2, E3 and E4 the mean particle size in the A1, A2 or A3 products is in the 2 μm-20 μm range.

The liquid laundry detergent compositions of composition Entries 1 to 12 all demonstrate excellent product stability as fully formulated composition as well as in diluted form during a laundering cycle. The liquid laundry detergent compositions of composition Entries 1 to 12 all provide excellent fabric cleaning and fabric care performance when added to the drum of an automatic washing machine wherein fabric are there and thereinafter laundered in conventional manner.

The compositions of Entries 1 to 12 are particularly advantageous with respect to fabric softening benefits imparted to fabrics treated therewith; this is especially true for colored fabrics on which the observed fabric softening benefits are even more enhanced in comparison to the fabric softening benefits provided onto white fabrics. The compositions of Entries 1, 2, 3, 10, 11, and 12 are also advantageous with respect to anti-abrasion benefits and to anti-pilling benefits provided for fabrics treated therewith. The compositions of Entries 1, 2, 3, 10, 11, and 12 are particularly advantageous with respect to color care benefits imparted to fabrics treated therewith.

It has moreover now been discovered that a major culprit in deactivating functionalized silicones or preventing their good working for promoting fabric care is chemical reaction of the functionalized silicone with certain perfumery ingredients, specifically perfumery aldehydes or ketones, or any associated compounds such as pro-perfumes capable of releasing the same such as acetals, ketals, orthoesters, orthoformates, and the like. Use of the specific types of functionalized and non-functionalized silicones in the blends described herein can help solve some of these special incompatibility problems involving perfumes.

Without being limited by theory, the nitrogen content of the functionalized polysiloxane is fundamentally linked to the ability to obtain miscibility of the functionalized and non-functionalized silicones, and the blend combination of the two acts synergistically. Moreover, while the levels of reactive group content needed are preferably low, they do not need to be zero. This is believed to be due, at least in part, to the ability of the non-functionalized silicone to protect the functionalized silicone from interaction with perfumery components of the aqueous liquid detergent composition. Therefore in broad general terms, to arrive at the benefits of the invention, one needs to have a miscible blend of an aminosilicone and a non-functional silicone, more preferably also an aminosilicone that has the specified structure and compositional limits set forth herein. By use of the invention it becomes un-necessary to resort to expensive encapsulation of perfume, and the fabric care benefits are excellent. Thus another aspect of the solution provided by the present invention is that use of the nonfunctional silicone permits a greater tolerance for reactive groups in the functionalized silicone than would otherwise be tolerable in terms of perfume compatibility.

The invention also encompasses a method for preparing a perfume-containing liquid laundry detergent, and the product of the method.

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An aqueous liquid laundry detergent composition suitable for cleaning and imparting fabric care benefits to fabrics laundered using such a composition, which composition comprises:

A) at least one surfactant selected from the group consisting of anionic surfactants, nonionic surfactants, zwitterionic surfactants, amphoteric surfactants, and combinations thereof;

B) droplets of a blend of silicone materials, which blend comprises:

i) an amine or ammonium group-containing functionalized polysiloxane material which:

a) has been prepared by a process which intrinsically leaves curable/reactive groups in the functionalized polysiloxane material which is produced;

b) has a molar ratio of curable/reactive group-containing silicon atoms to terminal silicon atoms containing no reactive/curable groups which is less than about 30%;

c) has a nitrogen content of from about 0.05% to about 0.30% by weight; and d) has viscosity at 20° C. ranging from about 0.00002 $m^2/s$ to about 0.2 $m^2/s$; and ii) a nitrogen-free, non-functionalized polysiloxane material having a viscosity of from about 0.01 $m^2/s$ to about 2.0 $m^2/s$ and present in an amount such that within said blend the weight ratio of functionalized polysiloxane material to non-functionalized polysiloxane material ranges from about 100:1 to about 1:100; and C) at least one additional non-silicone laundry adjunct selected from the group consisting of dye transfer inhibiting agents, optical brighteners, and combinations thereof.

2. A liquid laundry detergent composition according to claim 1 wherein said functionalized polysiloxane material has been prepared by a process which comprises hydrolysis of nitrogen-containing alkoxysilane and/or alkoxysiloxane starting materials and catalytic equilibration and condensation of these hydrolyzed starting materials; and has a molar ratio of curable/reactive group-containing silicon atoms to terminal silicon atoms containing no reactive/curable groups which is less than 20%, preferably less than 10%.

3. A liquid laundry detergent composition according to claim 1 wherein said composition comprises:

A) from about 5% to about 80% by weight of anionic surfactants, nonionic surfactants or combinations thereof;

B) from about 0.05% to about 10% by weight of said silicone blend which is miscible; and C) at least about 20% by weight of water and from about 0.0001% to about 2% by weight of an enzyme component and/or from about 0.01% to about 10% by weight of a dye transfer inhibiting agent and/or from about 0.01% to about 2% by weight of an optical brightener and/or from about 0.01% to about 15% by weight of a suds suppressor wherein at least one of the dye transfer inhibiting agent and/or the optical brightener is present in the composition.

4. A liquid detergent composition according to claim 1 wherein said functionalized polysiloxane material has a molar ratio of hydroxyl- and/or alkoxy-containing silicon atoms to terminal silicon atoms containing no hydroxyl or alkoxy groups which is less than 1.0%.

5. A liquid laundry detergent composition according to claim 1 wherein said functionalized polysiloxane has a molecular weight ranging from about 2,000 to about 100,000.

6. A liquid laundry detergent composition according to claim 1 wherein the weight ratio of functionalized polysiloxane to non-functionalized polysiloxane within said silicone blend ranges from about 1:20 to about 1:1.

7. A liquid laundry detergent composition according to claim 1 wherein said silicone blend is combined with an emulsifier and water and preformed into an oil-in-water emulsion suitable for addition as a separate component of the detergent composition.

8. A liquid laundry detergent composition according to claim 7 wherein within said emulsion contains from about 5% to about 60% by weight of the emulsion of said silicone blend.

9. A liquid laundry detergent composition according to claim 7 wherein within said emulsion the weight ratio of silicone blend to emulsifier ranges from about 200:1 to about 1:1 and the weight ratio of silicone blend to water ranges from about 1:50 to about 10:1.

10. A liquid laundry detergent composition according to claims 7 wherein the emulsifier used to form said emulsion is selected from the group consisting of alcohol ethoxylates, alkyl polyglucosides, ethoxylated and non-ethoxylated sorbitan esters, ethoxylated and non-ethoxylated fatty acid esters, ethoxylated and non-ethoxylated fatty amines and amides, ethoxylated glycerol esters and polyalkoxylated polysiloxanes.

11. A liquid laundry detergent composition according to claim 1 wherein the droplets of said silicone blend within said composition range in median particle size from about 0.5 to about 300 microns.

12. A liquid laundry detergent composition according to claim 1 wherein said functionalized polysiloxane within said silicone blend comprises an amino-polysiloxane having the formula:

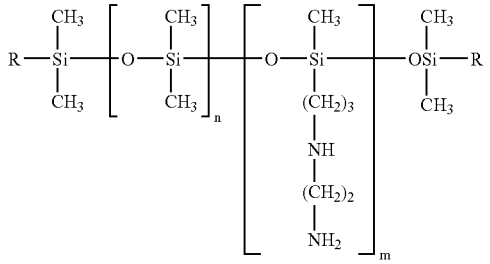

wherein R is independently selected from $C_1$ to $C_4$ alkyl, hydroxyalkyl and combinations thereof, and is preferably methyl and wherein n is a number from 49 to 1299, preferably from 100 to 1000, more preferably from 150 to 600; m is an integer from 1 to 50, preferably from 1 to 5; most preferably from 1 to 3 the sum of n and m is a number from 50 to 1300, preferably from 150 to 600.

13. A liquid laundry detergent composition according to claim 10 wherein said amino-polysiloxane has a nitrogen content of from 0.10% to 0.25% by weight and has a viscosity from 0.001 $m^2/s$ to 0.1 $m^2/s$, preferably from 0.002 $m^2/s$ to 0.01 $m^2/s$.

14. A liquid laundry detergent composition according to claim 1 wherein said composition contains a coacervate-forming polymer and/or a cationic deposition aid.

15. A liquid laundry detergent composition according to claim 1 wherein said non-functionalized polysiloxane is polydimethylsiloxane and has a viscosity ranging from about 0.5 $m^2/s$ to about 1.0 $m^2/s$.

16. An oil-in-water emulsion of silicone-based fabric care agents, which emulsion is suitable for incorporation into aqueous liquid laundry detergent compositions, said emulsion comprising:

A) from about 5% to about 60% by weight of the emulsion of a blend of miscible silicone materials, which blend comprises:

i) an amine or ammonium group-containing functionalized polysiloxane material which:

a) has been prepared by a process which intrinsically leaves curable/reactive groups in the functionalized polysiloxane material which is produced;

b) has a molar ratio of curable/reactive group-containing silicon atoms to terminal silicon atoms containing no reactive/curable groups which is less than about 30%;

c) has a nitrogen content of from about 0.05% to about 0.30% by weight; and d) has viscosity at 20° C. ranging from about 0.00002 $m^2/s$ to about 0.2 $m^2/s$; and ii) a nitrogen-free, non-functionalized polysiloxane material having a viscosity of from about 0.01 $m^2/s$ to about 2.0 $m^2/s$ and present in an amount such that within said blend the weight ratio of functionalized polysiloxane material to non-functionalized polysiloxane material ranges from about 100:1 to about 1:100;

B) an emulsifier present to the extent that the weight ratio of silicone blend to emulsifier ranges from about 200:1 to about 1:1; and C) water present in an amount such that the weight ratio of silicone blend to water ranges from about 1:50 to about 10:1;

wherein said silicone blend is dispersed within said emulsion in the form of droplets ranging in median size from about 0.5 to about 300 microns; and D) at least one additional non-silicone laundry adjunct selected from the group consisting of dye transfer inhibiting agents, optical brighteners, and combinations thereof.

17. An aqueous liquid laundry detergent composition suitable for cleaning and imparting fabric care benefits to fabrics laundered using such a composition, which composition comprises at least about 4% water and:

A) at least about 5% of at least one surfactant selected from the group consisting of anionic surfactants, nonionic surfactants, zwitterionic surfactants, amphoteric surfactants, and combinations thereof;

B) from about 0.01% to about 10% of droplets of a blend of highly miscible silicone materials, which blend comprises:

an amine or ammonium group-containing functionalized polysiloxane material having nitrogen content in the range from about 0.001% to about 0.5% and a curable-reactive group content, expressed as a molar ratio of curable-reactive group containing silicon atoms to terminal silicone atoms containing no curable-reactive groups, of not more than about 0.3;

a nitrogen-free, non-functionalized polysiloxane material having a viscosity of from about 0.01 $m^2/s$ to about 2.0 $m^2/s$ and present in an amount such that within said blend the weight ratio of functionalized polysiloxane material to non-functionalized polysiloxane material ranges from about 1:1.1 to about 1:1000;

C) from about 0.00001 to about 0.1% of fragrant compounds selected from perfumery aldehydes and ketones; and D) at least about 0.1% of liquid laundry detergent adjuncts selected from one or more of, preferably at least two or more of:

from 1% to 80% by weight of a detergent builder, chelant or mixture thereof;

from 0.0001% to 2% by weight of a detersive enzyme component;

from 0.01% to 10% by weight of a dye transfer agent;

from 0.0001% to about 1% of a pre-compounded silicone/silica antifoam agent; and from 0.00001% to about 0.5% of a non-staining dye or pigment; and from 0.000001% to about 0.2% of an optical brightener wherein at least one of the dye transfer inhibiting agent and/or the optical brightener is present in the composition.

18. A liquid laundry detergent composition according to claim 17 wherein said perfumery aldehydes are selected from the group composition one or more of: hexyl aldehyde, heptyl aldehyde, octyl aldehdyde, nonyl aldehyde, 3,5,5-trimethyl hexanal, decyl aldehyde, undecyl aldehyde, dodecyl aldehyde, nonenal, decenal (decenal-4-trans), undecenal (aldehyde iso C11, 10-Undecenal), nonadienal, 2,6,10-trimethyl-9-undecenal, 2-methylundecanal, geranial, neral, citronellal, dihydrocitronellal, 2,4-dimethyl-3-cyclohexene-1-carboxaldehyde, 2-methyl-3-(4-isopropylphenyl)propanal, 2-methyl-3-(4-tert.-butylphenyl)propanal, 2-methyl-3-(4-(2-methylpropyl)phenyl)propanal, anisic aldehyde, cetonal, 3-(3-isopropylphenyl)butanal, 2,6-dimethyl-heptenal, 4-methyphenylacetaldehyde, 1-methyl-4(4-methylpentyl)-3-cyclohexene-carbaldehyde, butyl cinnamic aldehyde, amyl cinnamic aldehyde, hexyl cinnamic aldehyde, 4-methyl-alpha-pentyl cinnamic aldehyde, alpha-2,2,3-tetramethyl-3-cyclopentene-1-butyraldehyde (santafleur), isohexenyl tetrahydro benzaldehyde, citronellyl oxyacetaldehyde, melafleur, lyral, 2-methyl-3 (para-methoxy phenyl)-propanal, cyclemone A, para-ethyl-alpha,alpha-dimethyl hydrocinnamaldehyde, dimethyl decadienal, alpah-methyl-3,4-(methylenedoxy) hydrocinnamaldehyde, isocyclocitral, methyl cinnamic aldehyde, methyl octyl aldehyde; and wherein said perfumery ketones are selected from one or more of: alpha-damascone, beta-damascone, delta-damascone, damascenone, dihydro ionone beta, geranyl acetone, benzyl acetone, beta ionone, alpha ionone, gamma methyl ionone, methyl heptenone, 2-(2-(4-methyl-3-cyclohexen-1-yl)propyl)cyclopentanone, 5-cyclohexadecen-1-one, 6,7-dihydro-1,1,2,3,3,-pentamethyl-4(5H)-indanone, heptyl cyclopentanone, hexyl cyclopentanone, 7-acetyl, 1,2,3,4,5,6,7,8-octahydro-1,1,6,7-tetramethyl naphthalene, isocyclemone E, methyl cedryl ketone, methyl dihydrojasmonate.

19. A method for preparing an aqueous liquid detergent comprising (a) fragrant compounds selected from perfumery aldehydes and ketones and (b) fabric care actives comprising silicones having functional groups that react therewith; said method comprising:

I) providing functional silicone materials selected from the group consisting of aminosilicones, ammonium functional silicones, substituted ammonium functional silicones and mixtures thereof wherein said functional silicones are miscible with non-functional silicones by virtue of said functional silicones having a nitrogen content in the range from about 0.001 to about 0.5% percent by weight of said functional silicones; said functional silicones having a molar ratio of curable/reactive group containing silicon atoms to terminal silicone atoms containing no curable/reactive groups of not more than 0.3;

II) blending said functional silicones with non-functional polysiloxane materials that are fully miscible therewith and have viscosity in the range from about 0.01 to about 2 $m^2/s$, optionally but preferably in the presence of at least one emulsifier and optionally but preferably with one or more silicone emulsion adjuncts; and III) combining the product of step (II) with an aqueous liquid detergent base formulation comprising at least about 4% water, at least 5% of a surfactant, at least one of a dye transfer inhibiting agent and/or an optical brightener, and said fragrant compounds selected from the group consisting of perfumery aldehydes and ketones at a level of from about 0.00001 to about 0.1% such that the final composition comprises discrete droplets of the miscible silicones having a mean particle size of no more than about 200 micron.

* * * * *